US008977154B2

(12) United States Patent
Takeuchi et al.

(10) Patent No.: US 8,977,154 B2
(45) Date of Patent: Mar. 10, 2015

(54) IMAGE FORMING DEVICE

(75) Inventors: Kenji Takeuchi, Nagoya (JP); Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 799 days.

(21) Appl. No.: 13/071,566

(22) Filed: Mar. 25, 2011

(65) Prior Publication Data

US 2011/0262159 A1 Oct. 27, 2011

(30) Foreign Application Priority Data

Apr. 27, 2010 (JP) ..... 2010-102424

(51) Int. Cl.
*G03G 15/20* (2006.01)
*G03G 15/00* (2006.01)

(52) U.S. Cl.
CPC ..... *G03G 15/657* (2013.01); *G03G 15/205* (2013.01); *G03G 15/2078* (2013.01)
USPC ..... 399/67; 399/68; 399/70; 399/322

(58) Field of Classification Search
CPC ..... G03G 15/20; G03G 15/2003; G03G 15/2014; G03G 15/2028; G03G 15/2039; G03G 15/2046; G03G 15/205; G03G 15/2078; G03G 15/2085
USPC ..... 399/44, 67–70, 322
See application file for complete search history.

(56) References Cited

U.S. PATENT DOCUMENTS

| | | | | |
|---|---|---|---|---|
| 6,501,919 | B1 * | 12/2002 | Yamaguchi | 399/70 |
| 6,701,102 | B2 | 3/2004 | Hasegawa et al. | |
| 7,057,141 | B1 * | 6/2006 | Moy | 219/497 |
| 7,177,560 | B2 * | 2/2007 | Fujisawa | 399/44 |
| 7,212,762 | B2 * | 5/2007 | Watabe | 399/70 |
| 8,032,046 | B2 * | 10/2011 | Otsuka | 399/69 |
| 8,150,289 | B2 * | 4/2012 | Yamashina et al. | 399/70 |
| 8,521,050 | B2 * | 8/2013 | Kuribayashi | 399/69 |
| 2002/0061200 | A1 * | 5/2002 | Sakakibara et al. | 399/69 |
| 2002/0118977 | A1 | 8/2002 | Hasegawa et al. | |
| 2011/0064441 | A1 * | 3/2011 | Morihara | 399/69 |

FOREIGN PATENT DOCUMENTS

| | | | |
|---|---|---|---|
| JP | 04-340559 | A | 11/1992 |
| JP | 10-010951 | | 1/1998 |
| JP | 2002-189378 | A | 7/2002 |
| JP | 2009-058802 | A | 3/2009 |
| JP | 2009-098508 | A | 5/2009 |

OTHER PUBLICATIONS

Google machine translation of JP 2009-098508, retrieved from j-tokkyo.com. Original patent publication May 7, 2009.*
JP Office Action mailed Mar. 21, 2012, JP Appln. 2010-102424, English translation.

* cited by examiner

*Primary Examiner* — David Gray
*Assistant Examiner* — Carla Therrien
(74) *Attorney, Agent, or Firm* — Banner & Witcoff, Ltd.

(57) ABSTRACT

An image forming device comprising a fixing unit for thermally fixing a developer on a recording sheet, a control unit that controls the temperature to maintain the fixing unit at one of a fixing temperature and a stand-by temperature lower than the fixing temperature, and a transport unit that transports the recording sheet to the fixing unit, wherein, when the temperature of the fixing unit has dropped from the fixing temperature to the stand-by temperature, and a printing command is received, the control unit controls the transport unit so as to set a stand-by time to wait before starting to transport the recording sheet after the printing command is received as a second time interval, which is longer than a first time interval of time required for the temperature of the fixing unit to reach the fixing temperature based on information relating to the current temperature of the fixing unit.

8 Claims, 3 Drawing Sheets

IMAGE FORMING DEVICE

This application is based upon and claims the benefit of priority of Japanese Patent Application No. 2010-102424 filed on Apr. 27, 2010, the contents of which are incorporated herein by reference in its entirety.

BACKGROUND

Apparatuses and methods consistent with the present disclosure relate to an image forming device that has a fixing unit for thermally fixing a developer on a recording sheet.

There has been a known control for a time interval up to starting paper feeding after receiving a printing command so that a heating roller in a fixing unit can reach its optimum fixing temperature when a recording sheet reaches the fixing unit. For example, in one of related arts, when a heater is ON for a predetermined time, the temperature increase rate of a detection temperature detected by a temperature sensor is calculated, and the time interval is controlled based on the temperature increase rate.

SUMMARY

However, according to the above configuration, if the printing command is output in a state where the temperature drops from the fixing temperature to a stand-by temperature, the temperature increase rate cannot be calculated. Thus, the recording sheet cannot be transported at a suitable timing, and it is difficult to carry out the fixing process at a suitable fixing temperature.

Thus, an object of an aspect of the disclosure is to provide an image forming device that can carry out the fixing process on the recording sheet at a suitable fixing temperature, even when the printing command is output in a state where the temperature drops from the fixing temperature to the stand-by temperature.

An aspect of the disclosure provides the following arrangements:

An image forming device comprising:

a fixing unit configured to thermally fix a developer on a recording sheet;

a control unit configured to control temperature to maintain the fixing unit at one of a fixing temperature and a stand-by temperature lower than the fixing temperature; and a transport unit configured to transport the recording sheet to the fixing unit, wherein, if the temperature of the fixing unit is dropping from the fixing temperature to the stand-by temperature, and a printing command is received, the control unit controls the transport unit so as to set, based on information relating to the current temperature of the fixing unit, a stand-by time to wait before starting to transport the recording sheet after the printing command is received as a second time interval, which is longer than a first time interval at the time the temperature of the fixing unit is the fixing temperature.

An image forming device comprising:

a fixing unit configured to thermally fix a developer on a recording sheet;

a control unit configured to control temperature to maintain the fixing unit at one of a fixing temperature and a stand-by temperature lower than the fixing temperature; and a transport unit configured to transport the recording sheet to the fixing unit, wherein the control unit controls the transport unit so as to set a stand-by time to wait before starting to transport the recording sheet after the printing command is received as a first time interval if the temperature of the fixing unit is a first temperature lower than the fixing temperature and higher than the stand-by temperature and a printing command is received, and wherein the control unit controls the transport unit so as to set the stand-by time as a second time interval longer than the first time interval if the temperature of the fixing unit is a second temperature lower than the first temperature and higher than the stand-by temperature and the printing command is received.

BRIEF DESCRIPTION OF THE DRAWINGS

FIG. 2 is an explanatory diagram that shows a temperature change of a heating roller after turning a power source of a laser printer ON.

DESCRIPTION OF EXEMPLARY EMBODIMENT

The Whole Configuration of Laser Printer

Figure 1:
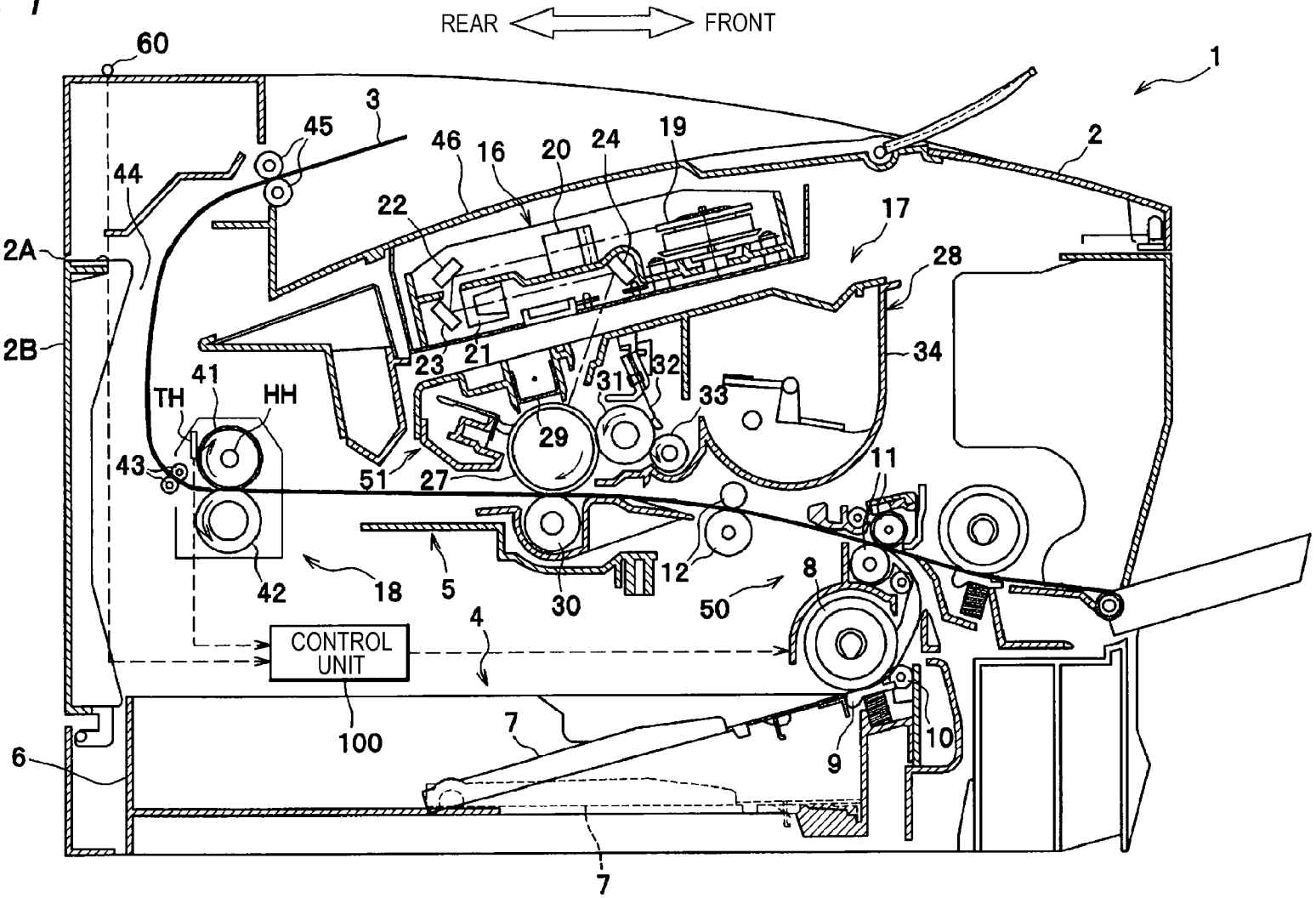
FIG. 1 is a cross-sectional view that shows a laser printer as an example of an image forming device according to an embodiment.

An exemplary embodiment will be described in detail with reference to appropriate drawings, As shown in FIG. 1, a laser printer 1 as an example of the image forming device includes a feeder portion 4 for supplying a paper 3 as an example of a recording sheet into a device main body 2, an image forming portion 5 for forming an image on the supplied paper 3 or the like.

The feeder portion 4 includes a paper feeding tray 6 which is mounted on a bottom portion in the device main body 2 in an attachable and detachable manner, and a paper pressing plate 7 which is provided in the paper feeding tray 6. Furthermore, the feeder portion 4 includes a paper feeding roller 8 and a paper feeding pad 9 provided in an upper part of an end portion of the paper feeding tray 6, and paper powder grasping rollers 10 and 11 provided in a downstream side of a transport direction of the paper 3 with respect to the paper feeding roller 8. Moreover, the filter portion 4 includes a resist roller 12 provided in a downstream side with respect to the paper powder grasping rollers 10 and 11.

Moreover, in the feeder portion 4 configured as above, the papers 3 within the paper feeding tray 6 approach the paper feeding roller 8 side via the paper pressing plate 7, are delivered by the paper feeding roller 8 and the paper feeding pad 9, pass through the respective rollers 10 to 12 and then are transported to the image forming portion 5 one by one.

The image forming portion 5 includes a scanner portion 16, a process cartridge 17, a fixing unit 18 or the like.

The scanner portion 16 is provided on an upper portion in the device main body 2 and includes a laser light emitting portion (not shown), a polygon minor 19 that is rotated and driven, lenses 20 and 21, and reflectors 22, 23 and 24 or the like. Moreover, in the scanner portion 16, a laser beam is irradiated on a surface of a photosensitive drum 27 of the process cartridge 17 through a path shown by dotted lines in the drawing at a high speed.

The process cartridge 17 is arranged on a lower part of the scanner portion 16 and can be attached to and detached from the device main body 2. Moreover, the process cartridge 17 is constituted by a developing cartridge 28 and a drum cartridge 51.

The developing cartridge 28 includes a developing roller 31, a layer thickness restriction blade 32, a supply roller 33 and a toner hopper 34.

The drum unit 51 includes a photosensitive drum 27, a charger 29 and a transfer roller 30.

In the process cartridge 17, the surface of the rotating photosensitive drum 27 is charged by the charger 29 and then is exposed by the high speed scanned laser beam from the scanner portion 16. As a result, the electric potential of the exposed surface of the photosensitive drum 27 is lowered, whereby an electrostatic latent image based on the image data is formed on the surface of the photosensitive drum 27.

Next, the toner within the developing cartridge 28 is supplied to the electrostatic latent image on the surface of the photosensitive drum 27 by the rotating developing roller 31, whereby the toner image is formed on the surface of the photosensitive drum 27. Thereafter, the paper 3 is transported between the photosensitive drum 27 and the transfer roller 30, whereby the toner image on the surface of the photosensitive drum 27 is transferred onto the paper 3.

In addition, in the present embodiment, a transport unit 50 for transporting the paper 3 to the fixing unit 18 is constituted by the above-mentioned feeder portion 4, the photosensitive drum 27 and the transfer roller 30. Furthermore, on the outer surface of the device main body 2, an environmental temperature sensor 60 is provided for detecting an environmental temperature outside the device main body 2, i.e., an environmental temperature of the fixing unit.

<Structure of Fixing Unit>

The fixing unit 18 is for thermally fixing the toner onto paper 3, and includes a halogen heater HH as an example of a heat source, a heating roller 41, a pressurization roller 42, and a thermistor TH as an example of a fixing temperature sensor.

The halogen heater HH is arranged inside the cylindrical heating roller 41 and heats the heating roller 41 from the inside thereof. Moreover, the halogen heater HH is suitably controlled by a control unit 100 described later in detail.

The heating roller 41 is a metallic member formed in approximately a cylindrical shape, and is rotatably supported by the device main body 2. Moreover, the heating roller 41 is configured to rotate by a driving force from a driving device (not shown) driven with a control signal from the control unit 100. In addition, the heating roller 41 may be formed in an aluminum cylinder member and circumferential surface of the aluminum cylinder member may be coated by PTFE.

The pressurization roller 42 is pressed to the heating roller 41 by a spring (not shown), and comes into contact with the heating roller 41. In addition, the pressurization roller 42 may be formed of a urethane rubber provided around a core metal and circumferential surface of the urethane rubber may be covered with a PTFE tube.

The thermistor TH is configured to detect a detection temperature of the heating roller 41, and is provided near the downstream side of a nip portion where the peripheral surface of the heating roller 41 contacts the peripheral surface of the pressurization roller 42. Data of the detection temperature detected by the thermistor TH is output to the control unit 100.

Moreover, in the fixing unit 18 configured in this manner, the heating roller 41 is heated by the halogen heater HH, whereby, when the paper 3 passes between the heating roller 41 and the pressurization roller 42, the toner image is fixed on the paper 3. Thereafter, the paper 3 is transported to the paper discharging passage 44 by the transport roller 43. In addition, the paper 3 transported to the paper discharging passage 44 is discharged onto the paper discharging tray 46 by the paper discharging roller 45.

<Configuration of Control Unit>

Next, a configuration of the control unit 100 will be described.

The control unit 100 has a CPU, a ROM, a RAM or the like, and is configured to perform the reception of a printing command and a printing data, and the control of the feeder portion 4, the image forming portion 5 or the like according to a program.

The control unit 100 is configured to selectively carry out a known control to maintain the detection temperature of the heating roller 41 at a fixing temperature Tf (see FIG. 2) used for fixing the toner image on the paper 3 and at a stand-by temperature Ts upon setting the laser printer 1 to the stand-by state.

The control unit 100 is further configured to control the transport unit 50 to set, based on the detection temperature, a stand-by time to wait until starting to transport the first paper 3 from the paper feeding tray 6 after printing command is received. In detail, the control unit 100 controls the transport unit 50 to set the stand-by time as a first time interval G1 when the detection temperature is the fixing temperature Tf.

Herein, the stand-by temperature Ts is a temperature lower than the fixing temperature Tf. In case that the current detection temperature is the stand-by temperature Ts and the stand-by time is set as the first time interval G1, the detection temperature will not reach the fixing temperature Tf by a timing when the first paper 3 reaches the fixing unit even if the halogen heater HH is turned ON when printing command is received even accounting for increment of the detection temperature.

Furthermore, the control unit 100 is configured to control the fixing unit 18 so as to turn OFF the halogen heater HH at timing t1 when the detection temperature initially reaches the fixing temperature Tf after the power source of the laser printer 1 is turned ON, thereby lowering the detection temperature to the stand-by temperature Ts.

Moreover, the control unit 100 is configured to carry out the unique control in accordance with the present embodiment, when the detection temperature of the heating roller 41 detected by the thermistor TH is dropping from the fixing temperature Tf to the stand-by temperature Ts at a timing when the printing command is received. Specifically, the control unit 100 controls the transport unit 50 to set the stand-by time as a second time interval G2 longer than the first time interval G1 based on the detection temperature at a timing when the printing command is received while the detection temperature is dropping from the fixing temperature Tf to the stand-by temperature Ts.

More specifically, the control unit 100 controls the transport unit 50 to set the stand-by time as the first time interval G1 if the detection temperature is between the fixing temperature Tf and a recoverable temperature Tc at a timing when the printing command is received while the detection temperature is dropping from the fixing temperature Tf to the recoverable temperature Tc. The control unit 100 further controls the transport unit 50 to set the stand-by time as the second time interval G2 if the detection temperature is between the recoverable temperature Tc and the stand-by temperature Ts at a timing when the printing command is received while the detection temperature is dropping from the recoverable temperature Tc to the stand-by temperature Ts.

Herein, the recoverable temperature Tc is a temperature between the fixing temperature Tf and the stand-by temperature Ts and is closer to the fixing temperature Tf than the stand-by temperature Ts. In case that the current detection temperature is the recoverable temperature Tc and the stand-by time is set as the first time interval G1, the detection temperature will become above the fixing temperature Tf at a timing when the first paper 3 reaches the fixing unit if the halogen heater HH is turned ON when printing command is received.

Moreover, when the control unit 100 controls the fixing unit 18 to maintain the detection temperature at the stand-by temperature Ts, the control unit 100 further controls the transport unit 50 to set the stand-by time as a third time interval G3 longer than the second time interval G2.

Furthermore, the control unit 100 changes the stand-by time so that, as the environmental temperature detected by the environmental sensor 60 becomes lower, the stand-by time is longer.

Figure 2:
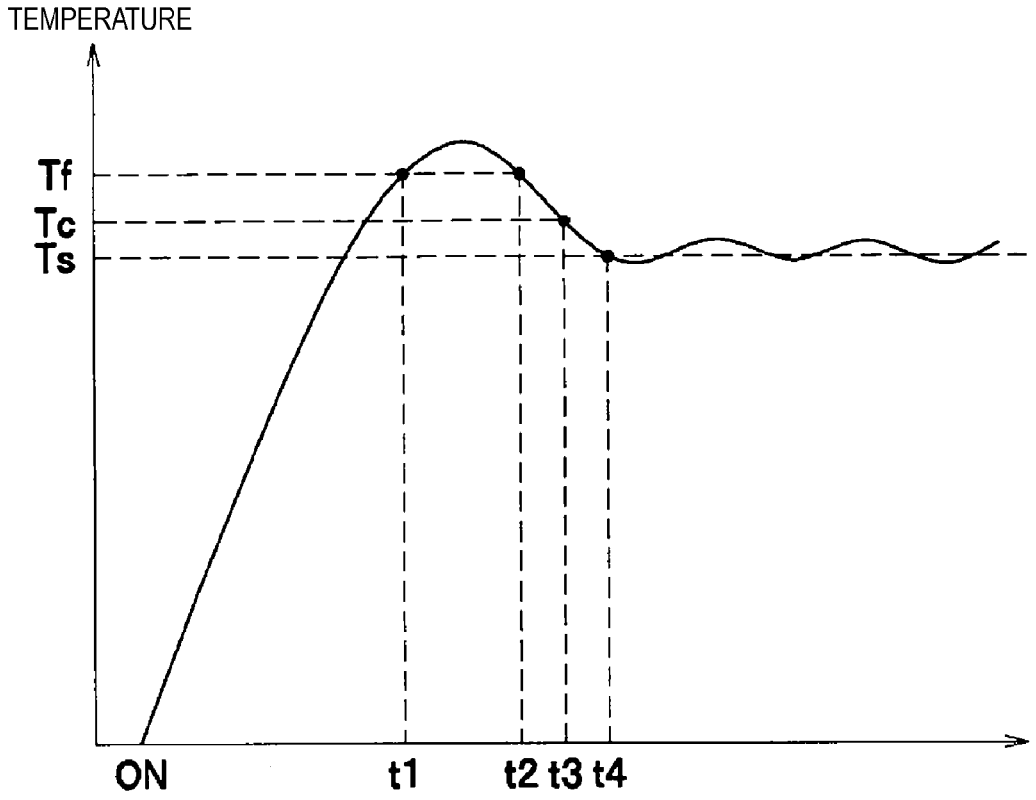

As mentioned above, the control unit 100 carries out the control, whereby, as shown in FIG. 2, in a state where the detection temperature is dropping from the fixing temperature Tf to the recoverable temperature Tc (timing t2 to t3), the stand-by time is set to the first time interval G1.

In addition, during a term from timing t1 when the halogen heater HH is turned OFF to timing t2 when the temporarily increased detection temperature has dropped to the fixing temperature Tf which is a target temperature, the stand-by time is set as the first time interval G1.

Furthermore, during a term from timing t3 to timing t4 when the detection temperature has further dropped to the stand-by temperature Ts, the stand-by time is set as the second time interval G2 longer than the first time interval G1. Furthermore, after the timing t4 the stand-by time is set as the third time interval G3 longer than that of the second time interval G2.

Hereinafter, a control of the control unit 100 will be described in detail with reference to FIG. 3.

Figure 3:
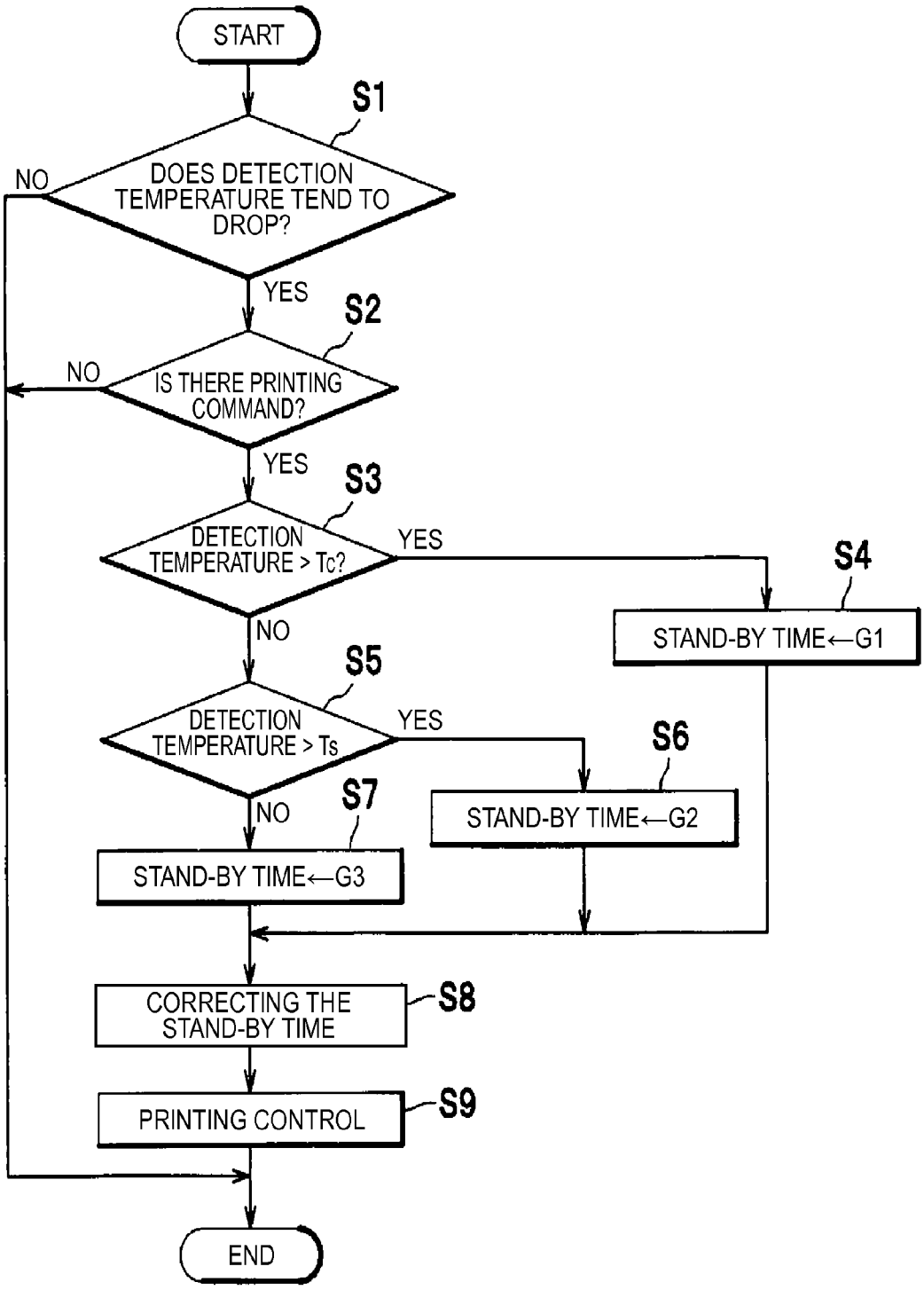
FIG. 3 is a flow chart that shows an operation of a control unit.

As shown in FIG. 3, the control unit 100 determines whether or not the detection temperature tends to drop by comparing the previous value of the detection temperature with the current value thereof (S1). If it is determined that the detection temperature tends to drop in step S1 (Yes), then the control unit 100 determines whether or not the printing command is received (S2).

If the printing command is not received in step S2 (No), the control unit 100 finishes the main control. If the printing command is received in step S2 (Yes), the control unit 100 determines whether or not the detection temperature is higher than the recoverable temperature Tc (S3).

If the detection temperature is higher than the recoverable temperature Tc in step S3 (Yes), the control unit 100 sets the stand-by time as the first time interval G1 (S4). If the detection temperature is equal to or less than the recoverable temperature Tc in step S3 (No), then the control unit 100 determines whether or not the detection temperature is higher than the stand-by temperature Ts (S5).

If the detection temperature is higher than the stand-by temperature Ts in step S5 (Yes), the control unit 100 sets the stand-by time as the second time interval G2 (S6). If the detection temperature is equal to or less than the stand-by temperature Ts in step S5 (No), the control unit 100 sets the stand-by time as the third time interval G3 (S7).

After setting the stand-by time in step S4, in step S6 or step S7, the control unit 100 corrects the stand-by time based on the environmental temperature detected by the environmental temperature sensor 60 (S8). Specifically, for example, a plurality of correction values is stored in a memory portion as a map depending on a plurality of environmental temperatures so that, as the environmental temperature becomes lower, the stand-by time is longer. The control unit 100 can determine the correction value by using the map based on the environmental temperature, thereby correcting the stand-by time in accordance with the determined correction value.

After step S8, the control unit 100 carries out printing control based on the corrected stand-by time (S9). Herein, the printing control is a known control, and the driving of the transport unit 50, turning ON of the halogen heater HH, the exposure control for the scanner portion 16 or the like are carried out. Moreover, a driving start timing of the transport unit 50 during printing control is suitably set depending on the corrected stand-by time.

That is, in the printing control, the control unit 100 starts the driving of the transport unit 50 after elapse of the corrected stand-by time in response to receiving the printing command. As a result, the paper feeding is started at the suitable timing depending on the time intervals G1, G2 and G3, even in a case where the detection temperature tends to drop. Therefore, when the paper 3 reaches the fixing unit 18, the detection temperature has reliably reached to the fixing temperature Tf.

In addition, in a case where the detection temperature does not tend to drop (S1; No), the control unit 100 finishes the main control and carries out the known control depending on respective cases. Specifically, in the case of carrying out the control of maintaining the detection temperature at the fixing temperature Tf, the stand-by time is set as the first time interval G1. In the case of carrying out the control of maintaining the detection temperature at the stand-by temperature Ts, the stand-by time is set as the third time period G3.

In addition, in a case where the detection temperature tends to rise, for example, the stand-by time may be determined by a method disclosed in the related art.

As described above, it is possible to obtain the following effect in the present embodiment.

Even in a case where the printing command is output while the detection temperature drops from the fixing temperature Tf to the stand-by temperature Ts, it is possible to perform the fixing process on the paper 3 at a suitable fixing temperature Tf.

While the detection temperature is between the fixing temperature Tf and the recoverable temperature Tc (step S3; Yes), the paper 3 is transported with the first time interval G1 used for regular printing operation (step S4). Thus, it needs not to wait to start printing between timings t2 and t3.

If the stand-by time were set as the second time interval G2 when the detection temperature is between the fixing temperature Tf and the recoverable temperature Tc, which is between timings t2 and t3, the stand-by time would be too long and a phenomenon in which the detection temperature exceeded greatly beyond the fixing temperature Tf might occur.

When the detection temperature is at the stand-by temperature Ts, the stand-by time is set at the time interval G3 longer than the second time interval G2, which is set in a case where the detection temperature tends to drop. Therefore, at the stand-by temperature Ts lower than temperature during its drop tendency time, it is possible to transport the paper 3 at a suitable timing, thereby performing the fixing process on the paper 3 at the suitable fixing temperature Tf.

The stand-by time may be corrected so that the stand-by time is longer as the environmental temperature becomes lower. Therefore, even when the environmental temperature is changed, it is possible to perform the fixing process in the paper 3 at the suitable fixing temperature Tf.

In addition, the present invention is not limited to the above-mentioned embodiment but can be practiced in various formations as described below.

In the above-mentioned embodiment, the temperature information detected by the thermistor TH is used as information relating to the temperature of the fixing unit 18, but the present embodiment is not limited thereto. For example, the time information including the elapsed time after turning the heat source of the fixing unit OFF may be used as the information relating to the temperature of the fixing unit 18.

Specifically, as shown in FIG. 2, if elapsed time from the timing t1 when the halogen heater HH is turned OFF is a first elapsed time α (α≤t3−t1), the stand-by time may be set as the first time interval G1. If the elapsed time is a second elapsed time β (t3−t1<β≤t4−t1), the stand-by time may be set as the second time interval G2. If the elapsed time is a third elapsed time γ (γ>t4−t1), the stand-by time may be set as the third time interval G3. Furthermore, the stand-by time may be set in accordance with elapsed time from timing of power ON of the laser printer 1.

In the above-mentioned embodiment, the present invention was applied to the laser printer 1, but the present invention is not limited thereto. The present invention can be applied to other kind of image forming devices, for example, a copier, a multi-function device or the like.

In the above-mentioned embodiment, the paper 3 may be a thick paper, a postcard, a thin paper, or an OHP sheet.

In the above-mentioned embodiment, the fixing unit 18 may include has a cylindrical fixing film instead of the heating roller 41.

Furthermore, the transport unit may further include an additional transport roller disposed between the fixing unit and the photosensitive drum. Furthermore, in a color printer, a transport unit may include a paper transport belt.

The above-mentioned embodiment may be applied to a state where the temperature is dropping from the fixing temperature Tf after printing.

In the state where the detection temperature of the fixing unit 18 is dropping from the fixing temperature Tf to the recoverable temperature Tc, the stand-by time may be set as a time interval longer than the first time interval G1 but shorter than the second time interval G2.

At the stand-by temperature Ts, the stand-by time may be set as the second time interval G2.

The environmental sensor 60 may be disposed at a position outside of the fixing unit 18 but inside the device main body 2 so as to detect the temperature inside the device main body 2.

It may be determined that the detection temperature of the foxing unit 18 tends to drop if a predetermined time has been elapsed after turning the laser printer 1 ON.

The stand-by time may be corrected in accordance with a predetermined calculation equation based on the environmental temperature.

Instead of the halogen heater HH, IH (Induction Heating) heater or a heating resistor may be used.

What is claimed is:

1. An image forming device comprising:

a fixing unit including a heater and configured to fix a developer on a recording sheet;

a fixing temperature sensor configured to detect a temperature of the fixing unit;

a transport unit configured to transport the recording sheet to the fixing unit;

a control unit configured to control the fixing unit to switch temperature of the fixing unit between a first temperature and a second temperature lower than a fixing temperature, wherein the control unit performs an initial control after turning on power and before receiving a printing command, in which after the temperature of the fixing unit reaches the first temperature for a first time by turning on the heater, the temperature of the fixing unit is lowered to the second temperature, the control unit is configured to control the transport unit to set a stand-by time, based on temperature information related to the temperature of the fixing unit, to wait until starting to transport the recording sheet after printing command is received, the stand-by time is set at a first time interval when the temperature of the fixing unit is at the first temperature, the stand-by time is set in accordance with temperature information detected by the fixing temperature sensor, and the stand-by time is set at a second time interval longer than the first time interval if a printing command is received while the temperature of the fixing unit is dropping from the first temperature to the second temperature at the initial control.

2. The image forming device according to claim 1, wherein the first temperature is a fixing temperature and the second temperature is a stand-by temperature, and the control unit is configured to control the transport unit to set the stand-by time as the first time interval, if the printing command is received while the temperature of the fixing unit is dropping from the fixing temperature to a recoverable temperature, the recoverable temperature being lower than the fixing temperature but higher than the stand-by temperature.

3. The image forming device according to claim 2, wherein the control unit is configured to control the transport unit to set the stand-by time as the second time interval, if the printing command is received while the temperature of the fixing unit is dropping from the recoverable temperature to the stand-by temperature.

4. The image forming device according to claim 1, wherein the first temperature is a fixing temperature and the second temperature is a stand-by temperature, the control unit is configured to maintain the temperature of the fixing unit at the stand-by temperature, and the control unit controls the transport unit to set the stand-by time as a third time interval longer than the second time interval if the printing command is received while the control unit controls the fixing unit to maintain the temperature at the stand-by temperature.

5. The image forming device according to claim 1, further comprising:

an environmental temperature sensor configured to detect an environmental temperature outside the fixing unit, wherein the control unit is configured to correct the stand-by time so that the stand-by time is longer as the environmental temperature is lower based on the environmental temperature detected by the environmental temperature sensor.

6. The image forming device according to claim 1, wherein the stand-by time is set in accordance with the temperature information, that is a time elapsed after turning off a heat source of the fixing unit.

7. An image forming device comprising:

a fixing unit configured to fix a developer on a recording sheet;

a fixing temperature sensor configured to detect a temperature of the fixing unit;

a transport unit configured to transport the recording sheet to the fixing unit; and a control unit configured to control the fixing unit to maintain temperature of the fixing unit at one of a fixing temperature and a stand-by temperature lower than the fixing temperature; and wherein the control unit performs an initial control after turning on power and before receiving a printing command, in which after the temperature of the fixing unit reaches the fixing temperature, the temperature of the fixing unit is lowered to the stand-by temperature, the control unit is configured to control the transport unit to set a stand-by time to wait until starting to transport the recording sheet after the printing command is received as a first time interval if the temperature of the fixing unit is a first temperature lower than the fixing temperature and higher than the stand-by temperature when a printing command is received, and the control unit is further configured to control the transport unit to set the stand-by time in accordance with temperature information detected by the fixing temperature sensor and as a second time interval longer than the first time interval if the temperature of the fixing unit is a second temperature lower than the first temperature and higher than the stand-by temperature at the initial control when the printing command is received.

8. The image forming device according to claim 7, wherein the control unit is configured to control the transport unit to set the stand-by time as a third time interval longer than the second time interval if the printing command is received while maintaining the temperature of the fixing unit at the stand-by temperature.

* * * * *